US009120313B2

(12) United States Patent
Owaki et al.

(10) Patent No.: US 9,120,313 B2
(45) Date of Patent: Sep. 1, 2015

(54) LIQUID EJECTING HEAD UNIT AND LIQUID EJECTING APPARATUS

(71) Applicant: SEIKO EPSON CORPORATION, Tokyo (JP)

(72) Inventors: Hiroshige Owaki, Okaya (JP); Katsuhiro Okubo, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 42 days.

(21) Appl. No.: 13/850,457

(22) Filed: Mar. 26, 2013

(65) Prior Publication Data

US 2013/0293635 A1 Nov. 7, 2013

(30) Foreign Application Priority Data

May 2, 2012 (JP) ..... 2012-105454
Oct. 15, 2012 (JP) ..... 2012-227709

(51) Int. Cl.

| | |
|---|---|
| ***B41J 2/15*** | (2006.01) |
| ***B41J 29/38*** | (2006.01) |
| ***B41J 2/145*** | (2006.01) |
| ***B41J 2/155*** | (2006.01) |

(52) U.S. Cl.
CPC *B41J 2/145* (2013.01); *B41J 2/155* (2013.01); *B41J 2202/20* (2013.01)

(58) Field of Classification Search
CPC .... B41J 11/008; B41J 11/2135; B41J 25/001; B41J 2/0458
USPC ..... 347/40, 12
See application file for complete search history.

(56) References Cited

U.S. PATENT DOCUMENTS

| | | | | |
|---|---|---|---|---|
| 5,782,184 | A * | 7/1998 | Albertalli et al. | 101/486 |
| 6,315,390 | B1 | 11/2001 | Fujii et al. | |
| 6,585,350 | B2 | 7/2003 | Barinaga | |
| 6,652,081 | B2 | 11/2003 | Shimizu | |
| 6,926,385 | B2 * | 8/2005 | Rai et al. | 347/40 |
| 6,955,788 | B2 * | 10/2005 | Richards | 435/286.2 |
| 6,975,466 | B2 * | 12/2005 | Umeyama et al. | 359/896 |
| 7,036,910 | B2 * | 5/2006 | Ohashi et al. | 347/50 |
| 7,073,884 | B2 * | 7/2006 | Ueda | 347/20 |
| 7,114,793 | B2 | 10/2006 | Katsuta et al. | |
| 7,264,346 | B2 | 9/2007 | Nishino et al. | |
| 7,322,394 | B2 * | 1/2008 | Nakamura et al. | 156/356 |
| 7,431,428 | B2 * | 10/2008 | Yamada | 347/49 |
| 7,699,417 | B2 * | 4/2010 | Inoue | 347/8 |
| 7,992,967 | B2 * | 8/2011 | Yamanaka | 347/50 |
| 2002/0033857 | A1 * | 3/2002 | Ohashi et al. | 347/20 |

(Continued)

FOREIGN PATENT DOCUMENTS

| | | |
|---|---|---|
| JP | 2000-351211 | 12/2000 |
| JP | 2002-264322 | 9/2002 |

(Continued)

*Primary Examiner* — Matthew Luu
*Assistant Examiner* — Patrick King
(74) *Attorney, Agent, or Firm* — Workman Nydegger

(57) ABSTRACT

A liquid ejecting head unit includes a plurality of liquid ejecting heads each having a liquid ejecting surface provided with a nozzle row in which nozzle openings through which liquid is discharged are aligned in a first direction, and a holding member having a holder to which the liquid ejecting head is attached. Further, in the above liquid ejecting head unit, a positioning reference that specifies relative positions between the liquid ejecting heads is provided to the holder, and the liquid ejecting head is fixed to the holder being positioned in compliance with the positioning reference.

15 Claims, 12 Drawing Sheets

(56) References Cited

U.S. PATENT DOCUMENTS

| | | | | |
|---|---|---|---|---|
| 2006/0214986 | A1* | 9/2006 | Yagi et al. | 347/40 |
| 2009/0174750 | A1* | 7/2009 | Saito | 347/40 |
| 2009/0189943 | A1* | 7/2009 | Taira et al. | 347/20 |
| 2009/0231390 | A1 | 9/2009 | Ouchi | |
| 2009/0295882 | A1 | 12/2009 | Hagiwara | |
| 2010/0214350 | A1* | 8/2010 | Oguchi | 347/20 |
| 2011/0050815 | A1 | 3/2011 | Kakigahara | |
| 2011/0063368 | A1* | 3/2011 | Kim et al. | 347/40 |
| 2011/0221822 | A1 | 9/2011 | Hagiwara et al. | |

FOREIGN PATENT DOCUMENTS

| | | |
|---|---|---|
| JP | 2008-221745 | 9/2008 |
| JP | 2010-167607 | 8/2010 |

* cited by examiner

LIQUID EJECTING HEAD UNIT AND LIQUID EJECTING APPARATUS

CROSS REFERENCES TO RELATED APPLICATIONS

The entire disclosure of Japanese Patent Application Nos. 2012-105454, filed May 2, 2012 and 2012-227709, filed Oct. 15, 2012 are incorporated by reference herein.

BACKGROUND

1. Technical Field

The present invention relates to liquid ejecting head units and liquid ejecting apparatuses, particularly to ink jet recording head units that discharge ink as liquid and ink jet recording apparatuses.

2. Related Art

A liquid ejecting apparatus represented by an ink jet recording apparatus such as an ink jet printer, a plotter, or the like includes a liquid ejecting head unit (hereinafter, also called a "head unit") provided with a plurality of liquid ejecting heads capable of ejecting liquid such as ink or the like that is stored in a cartridge, a tank, or the like, in the form of droplets.

Each of the liquid ejecting heads includes a nozzle row in which nozzle openings through which ink is discharged are aligned. The plurality of liquid ejecting heads form a plurality of head rows arranged in a zigzag pattern along an alignment direction of the nozzle row, and are mounted on a common holding member (for example, see JP-A-2010-167607). By aligning the plurality of liquid ejecting heads as described above, a liquid ejecting head unit having a long nozzle row is provided.

To prevent deterioration of the print quality, it is preferable for an interval between the head rows to be smaller. In other word, it is preferable for the head rows to be closer to each other. Therefore, the parts (flanges in JP-A-2010-167607) for fixing the liquid ejecting heads to holders are provided on both sides in the alignment direction of each of the liquid ejecting heads. Since the flanges provided in this manner are not located between the head rows, it is possible to make the head rows closer to each other accordingly.

The head rows of the liquid ejecting heads arranged in the zigzag pattern are configured so that the nozzle openings are arranged in series. In other words, the position of an end of the nozzle row in the liquid ejecting head belonging to one head row overlaps in the alignment direction with the position of an end of the nozzle row in the liquid ejecting head belonging to an adjacent head row.

Since the liquid ejecting heads are arranged so that the positions of the nozzle rows overlap with each other in the manner described above, the liquid ejecting heads are also arranged to be close to each other in the alignment direction. This makes the intervals in the alignment direction between the liquid ejecting heads smaller; as a result, a large space cannot be ensured.

The flange is located inside the interval between the liquid ejecting heads in the alignment direction. However, as described above, because the interval cannot be made larger, the size (area) of the flange cannot be made larger. In other words, the parts for fixing the liquid ejecting heads to the holding member are caused to have a minute detailed structure, thereby raising a risk that the liquid ejecting heads fixed to the holding member become unstable.

Note that the above problem occurs not only in an ink jet recording head unit, but also occurs similarly in a liquid ejecting recording head unit that ejects liquid other than ink.

SUMMARY

An advantage of some aspects of the invention is to provide a liquid ejecting head unit and a liquid ejecting apparatus in which the liquid ejecting heads are stably fixed to a holding member so as to keep a preferable discharge characteristic.

A liquid ejecting head unit according to an aspect of the invention includes: a plurality of liquid ejecting heads each having a liquid ejecting surface provided with a nozzle row in which nozzle openings through which liquid is discharged are aligned in a first direction; and a holding member having a base portion and holders which are erected on the base portion and to which the liquid ejecting heads are attached. In the liquid ejecting head unit, the plurality of liquid ejecting heads form two head rows arranged in a zigzag pattern along the first direction, and also form a single nozzle row unit in which the above-mentioned nozzle rows are continued; the two head rows are arranged sandwiching the holders therebetween, and are arranged so that the liquid ejecting surfaces are positioned on the opposite side to the base portion; a positioning reference that specifies relative positions between the liquid ejecting heads is provided to the holders; and the liquid ejecting heads are fixed to the holders being positioned in compliance with the above positioning reference.

According to the aspect of the invention, the nozzle row unit is formed through shortening the interval in the first direction between the liquid ejecting heads, and the liquid ejecting head unit in which the liquid ejecting heads are stably fixed to the holding member is provided. Further, the liquid ejecting head unit is stably fixed to the holding member in a state of being arranged with high precision so that the relative positions of the liquid ejecting heads form the nozzle row unit, thereby having a preferable liquid discharge characteristic.

In the case where a direction orthogonal to the first direction in the liquid ejecting surface is taken as a second direction, it is preferable for the positioning reference to be provided so as to specify at least the relative positions in the first and second directions between the liquid ejecting heads that are fixed to the holders being positioned in compliance with the positioning reference. With this, each of the liquid ejecting heads can be positioned in the first and second directions in compliance with the positioning reference provided to the holders. In other words, only by positioning the liquid ejecting heads in compliance with the positioning reference, it is possible to obtain a liquid ejecting head unit in which the relative positions in the first and second directions between the liquid ejecting heads are specified.

In the case where a direction orthogonal to the first direction in the liquid ejecting surface is taken as the second direction and a direction orthogonal to both the first and second directions is taken as a third direction, it is preferable for the positioning reference to be provided so as to specify at least the relative positions in the third direction between the liquid ejecting heads that are fixed to the holders being positioned in compliance with the positioning reference. With this, each of the liquid ejecting heads can be positioned in the third direction in compliance with the positioning reference provided to the holders. In other words, only by positioning the liquid ejecting heads in compliance with the positioning reference, it is possible to obtain a liquid ejecting head unit in which the relative positions in the third direction between the liquid ejecting heads are specified.

In the case where a direction orthogonal to the first direction in the liquid ejecting surface is taken as the second direction and a direction orthogonal to both the first and second directions is taken as the third direction, it is preferable that a base portion-side reference be provided to the base portion, and that the base portion-side reference be provided so as to specify at least the relative positions in the third direction between the liquid ejecting heads that are fixed to the holders being positioned in compliance with the base portion-side reference. With this, each of the liquid ejecting heads can be positioned in the third direction in compliance with the positioning reference provided to the base portion. In other words, only by positioning the liquid ejecting heads in compliance with the positioning reference, it is possible to obtain a liquid ejecting head unit in which the relative positions in the third direction between the liquid ejecting heads are specified.

It is preferable that a lead-in structure that guides the liquid ejecting head to the holder side be provided in the holder. With this, it becomes easier to attach the liquid ejecting head to the holder by providing the lead-in structure in the holder. Accordingly, it is possible to reduce a workload, time, or the like needed for exchanging the liquid ejecting heads, thereby reducing maintenance costs in exchanging the liquid ejecting heads.

It is preferable for the liquid ejecting head to include a main head body for discharging liquid, a channel member which is connected to the main head body and in which a liquid channel is provided, and a fixing portion that is provided in the channel member and that sticks out in the first direction. Further, it is preferable that the holder of the holding member include a head attachment surface to which the fixing portion is fixed and an accommodation portion recessed from the head attachment surface, the fixing portion of the liquid ejecting head be fixed to the head attachment surface, and the main head body and the channel member be accommodated in the accommodation portion. With this, it is possible to shorten an interval in the second direction between the head rows that are arranged sandwiching the holders therebetween. In other words, an interval between the nozzle rows can be shortened. By shortening the interval in the second direction between the nozzle rows as described above, it is possible to suppress influence of meandering transport of a medium onto which liquid is discharged, whereby deterioration in the print quality can be prevented.

It is preferable that the base portion and the holders be integrally formed in the holding member. With this, since rigidity of the holding member is enhanced, the liquid ejecting heads can be further stably fixed to the holding member.

Further, the liquid ejecting head unit can be characterized in that it includes the plurality of liquid ejecting heads each having the liquid ejecting surface provided with the nozzle row in which the nozzle openings through which liquid is discharged are aligned in the first direction, and the holding member in which the liquid ejecting head is attached to a surface of the holder intersecting with the liquid ejecting surface; the holder is provided with the positioning reference for specifying the relative positions between the liquid ejecting heads; and each of the liquid ejecting heads is fixed to the holder being positioned in compliance with the positioning reference.

In addition, the liquid ejecting head unit can be also characterized in that the liquid ejecting head includes the main head body for discharging liquid and the fixing portion sticking out in the first direction from the main head body; the holder of the holding member includes the head attachment surface to which the fixing portion is fixed and the accommodation portion recessed from the head attachment surface; the fixing portion of the liquid ejecting head is fixed to the head attachment surface; and at least part of the main head body is accommodated in the accommodation portion.

A liquid ejecting apparatus according to another aspect of the invention includes the liquid ejecting head unit according to the aforementioned aspect.

According to this aspect of the invention, a liquid ejecting apparatus in which the liquid ejecting heads are stably fixed to the holding member so as to provide a favorable discharge characteristic can be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, the invention will be described in detail based on embodiments of the invention. An ink jet recording head unit is an example of a liquid ejecting head unit and is simply called a "head unit" as well. An ink jet recording head is an example of a liquid ejecting head and is simply called a "head" as well.

Figure 1:
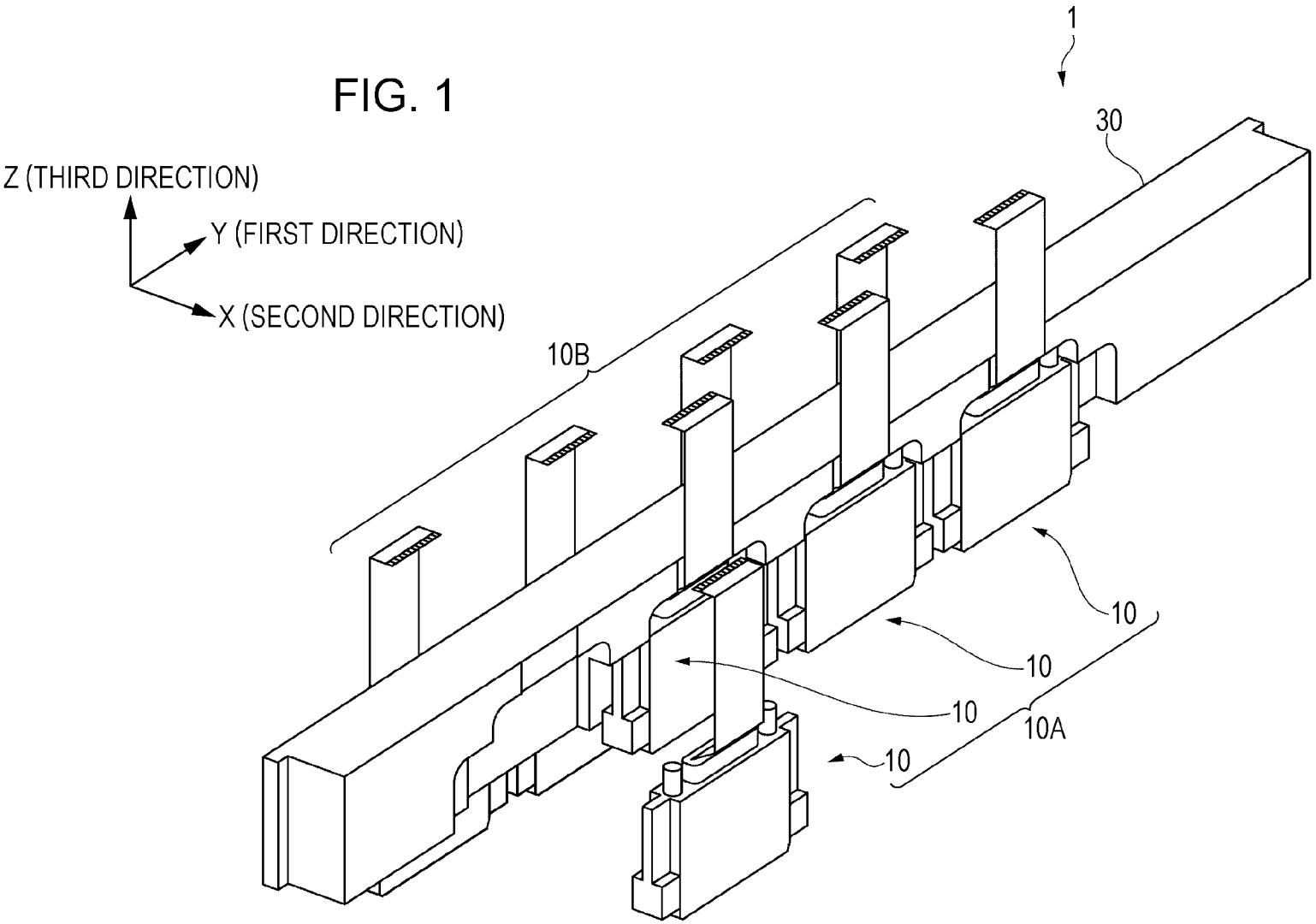
FIG. 1 is a schematic perspective view illustrating the top face side of a head unit according to an embodiment of the invention.
Figure 2:
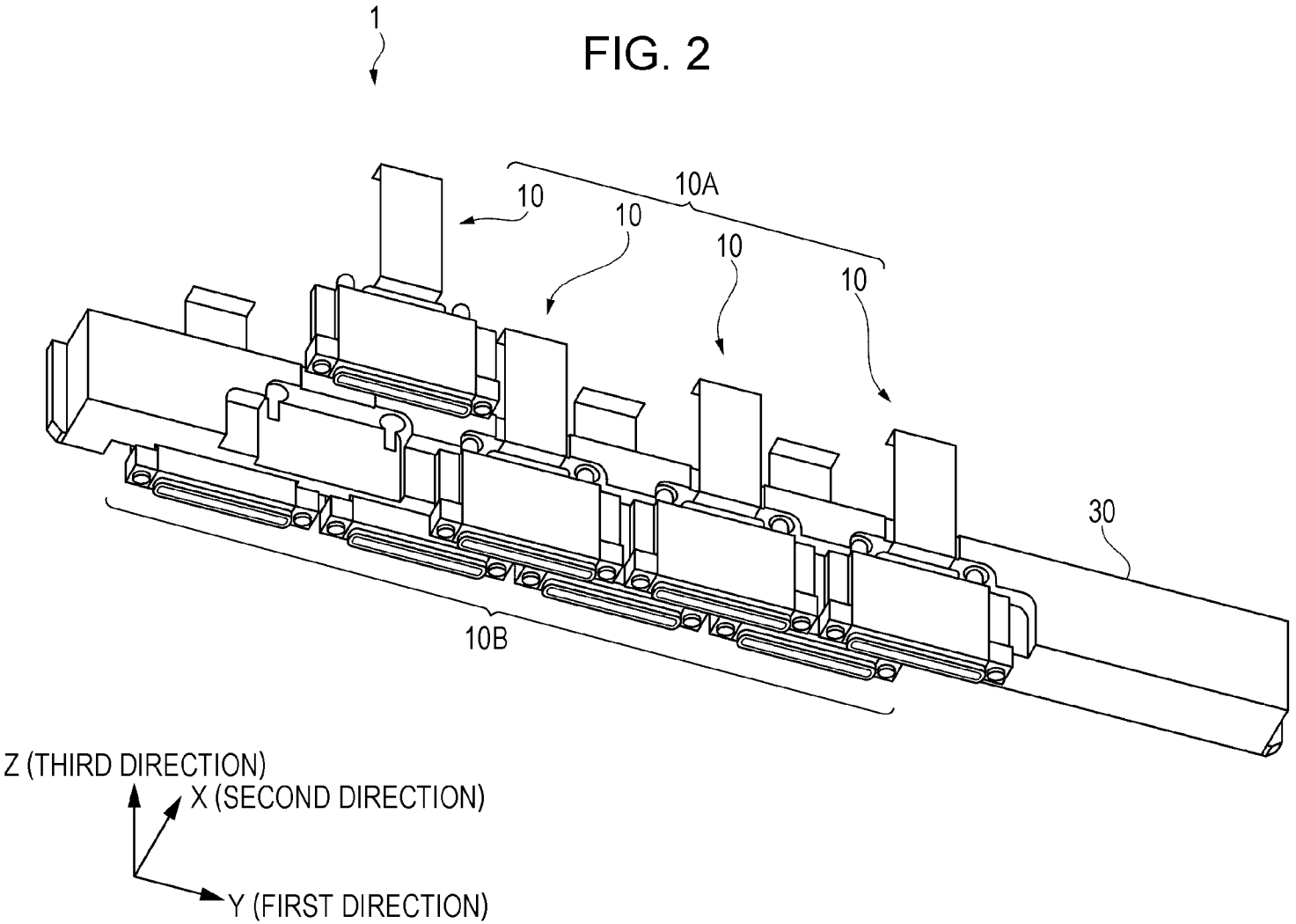
FIG. 2 is a schematic perspective view illustrating the bottom face side of the head unit according to the embodiment.

FIG. 1 is a schematic perspective view illustrating the top face side of a head unit according to a first embodiment of the invention, and FIG. 2 is a schematic perspective view illustrating the bottom face side of the head unit according to the embodiment. The top face side of the head unit is a face on the opposite side to a liquid ejecting surface of a head to be explained later, and the bottom face side of the head unit is a face on the liquid ejecting surface side.

A head unit 1 includes a plurality of heads 10 and a holding member 30 that holds the heads 10.

The heads 10 form two head rows configured of head rows A and B in each of which four heads are aligned in a Y direction (first direction). The head rows A and B are arranged opposite to each other sandwiching the holding member 30 therebetween, and fixed to the holding member 30 in a state in which the relative positions between the heads 10 are specified.

Figure 3:
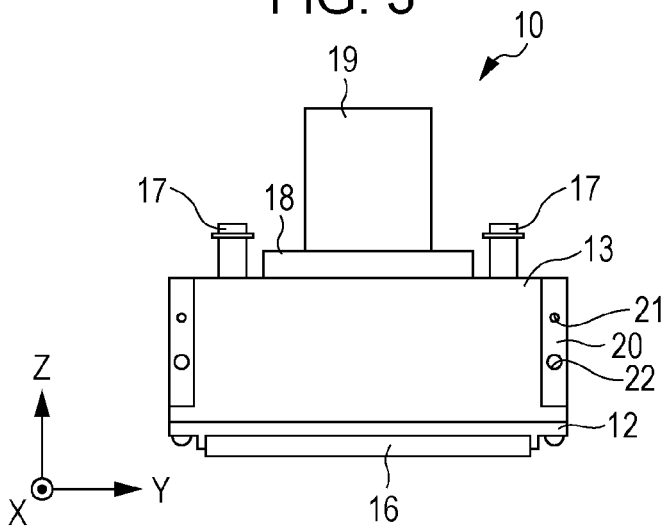
FIG. 3 is a front view illustrating the head according to the embodiment.
Figure 4:
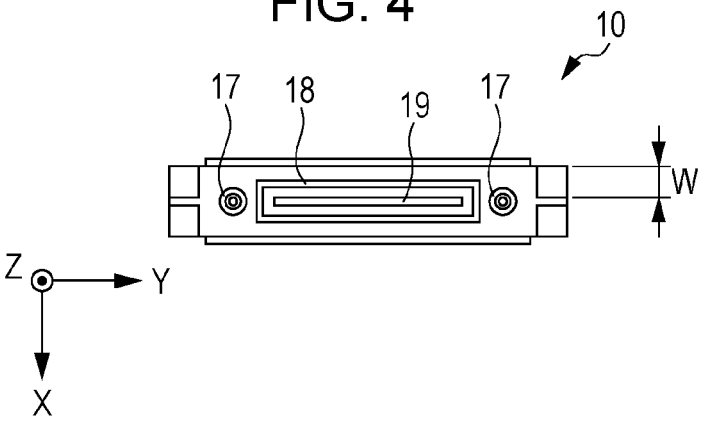
FIG. 4 is a top view illustrating the head according to the embodiment.
Figure 5:
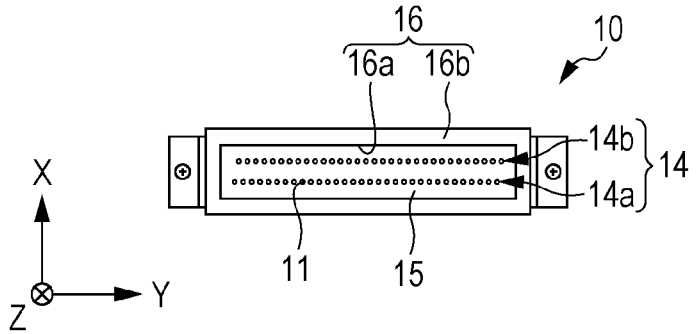
FIG. 5 is a bottom view illustrating the head according to the embodiment.

The head 10 will be described in detail with reference to FIGS. 3 through 5. FIG. 3 is a front view of the head 10, FIG. 4 is a top view of the head 10, and FIG. 5 is a bottom view of the head 10.

The head 10 includes a main head body 12 provided with nozzle openings 11, and a channel member 13 fixed to a surface on the opposite side of the main head body 12 to the nozzle openings 11.

The main head body 12 includes a nozzle row 14. A surface provided with the nozzle row 14 is referred to as a nozzle surface 15 (liquid ejecting surface).

The nozzle row 14 is a row in which a plurality of nozzle openings 11 are aligned in the Y direction (first direction). In this embodiment, two nozzle rows 14*a* and 14*b* are provided in which the nozzle openings 11 are aligned extending linearly in the Y direction. The nozzle openings 11 of the nozzle row 14*a* as one row and the nozzle openings 11 of the nozzle row 14*b* as the other row are formed while being shifted from each other by a half pitch. The nozzle rows 14*a* and 14*b* are configured to eject the same kind of liquid, and the two nozzle rows 14*a* and 14*b* form substantially the single nozzle row 14. In the invention, the nozzle row 14 formed in a substantially single nozzle row is called a nozzle row. With this configuration, the resolution can be doubled. The nozzle row may be formed in a mode in which three or more rows configure substantially a single nozzle row. Needless to say, it may be that the head 10 is provided with a nozzle row formed by just one row. Moreover, it may be that the head 10 includes two or more nozzle rows and these nozzle rows eject different kinds of liquid from each other; in this case, a plurality of nozzle rows will be provided.

A cover head 16 to protect the nozzle surface 15 is provided on the main head body 12. The cover head 16 is configured of an opening portion 16*a* from which the nozzle row 14 is exposed and a frame 16*b* that defines the opening portion 16*a*. The frame 16*b* covers the circumferential portion of the nozzle surface 15 so as to protect the nozzle surface 15.

Inside the main head body 12, although not shown, there are provided a pressure generation chamber configuring a part of a channel that communicates with the nozzle openings 11 and a pressure generation unit that causes a change in pressure in the pressure generation chamber so as to discharge liquid through the nozzle openings.

The pressure generation unit is not limited to any specified one, and the following can be used, for example: that is, a unit that employs a piezoelectric element in which a piezoelectric material having an electromechanical conversion function is sandwiched between two electrodes; a unit such that a heating element is provided within the pressure generation chamber and droplets are discharged through the nozzle openings 11 by bubbles generated by the heat from the heating element; a unit such that static electricity is generated between a vibration plate and electrodes and droplets are discharged through the nozzle openings 11 by the deformation of the vibration plate due to electrostatic force; and so on. As a piezoelectric element, the following can be used: that is, a flexural vibration type piezoelectric element in which a lower-side electrode, a piezoelectric material, and an upper-side electrode are laminated in that order from the pressure generation chamber side so as to generate flexural vibration; a longitudinal vibration type piezoelectric element in which a piezoelectric material and an electrode formation material are alternately laminated so as to make the laminated materials expand and contract in the axis direction; and so on.

The channel member 13 is a member that is fixed to a surface on the opposite side to the nozzle opening 11 of the main head body 12, and that supplies ink from external to the main head body 12 and discharges ink from the main head body 12 to external. An ink channel connection portion 17 through which an internal channel is opened and connected with an external channel and a connector 18 to which an electric signal such as a print signal or the like is supplied from external, are provided on a surface on the opposite side of the channel member 13 to the surface thereof which is fixed to the main head body 12. Further, a flexible connection wiring 19 such as an FPC or the like for transmitting the print signal is connected to the connector 18.

A fixing portion 20 sticking out in the Y direction is provided in the channel member 13. The fixing portion 20 is formed in a plate-like shape approximately parallel with a Y-Z plane, and is provided approximately at the center in the X direction of the channel member 13. In the fixing portion 20, a positioning hole 21 and a fixing screw insertion hole 22 are provided penetrating through in the thickness direction. The positioning hole 21 and the fixing screw insertion hole 22 are positioned in compliance with the positioning reference of the holding member 30, details of which will be explained later. The positioning hole 21 and the fixing screw insertion hole 22 are fixed to the holding member 30 being positioned in compliance with the positioning reference, whereby the relative positions between the heads 10 are specified.

Figure 6:
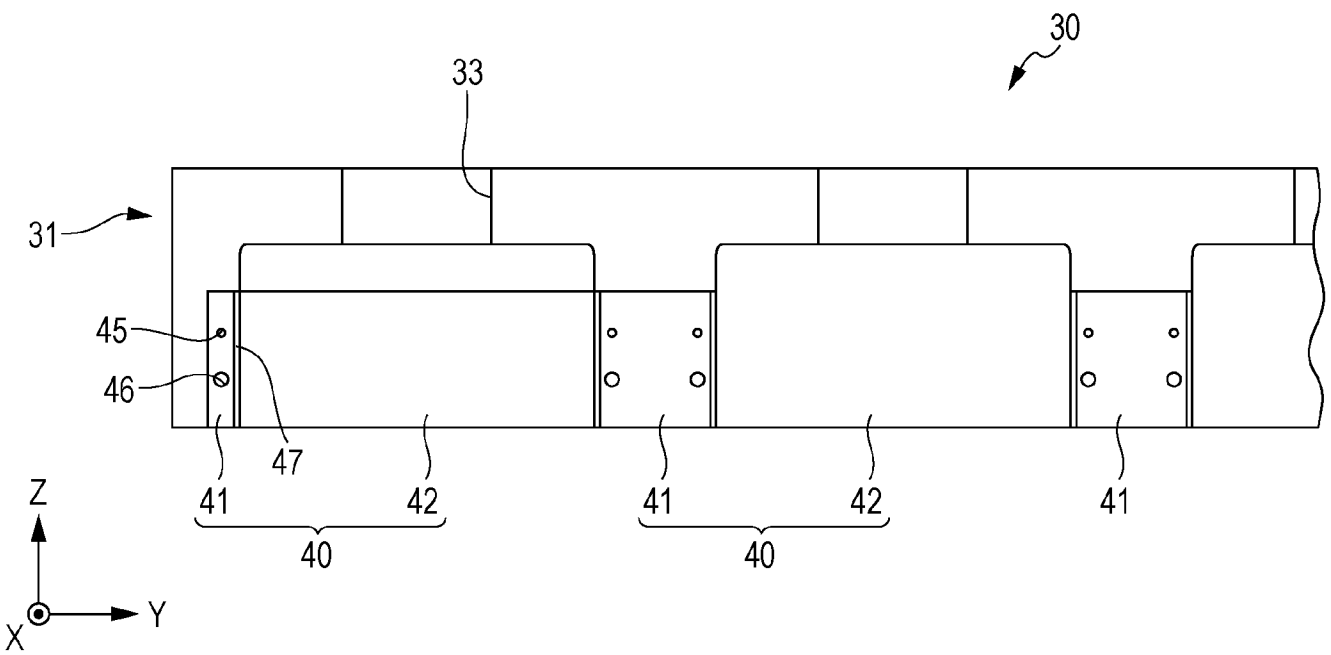
FIG. 6 is a front view illustrating a holding member according to the embodiment.
Figure 7:
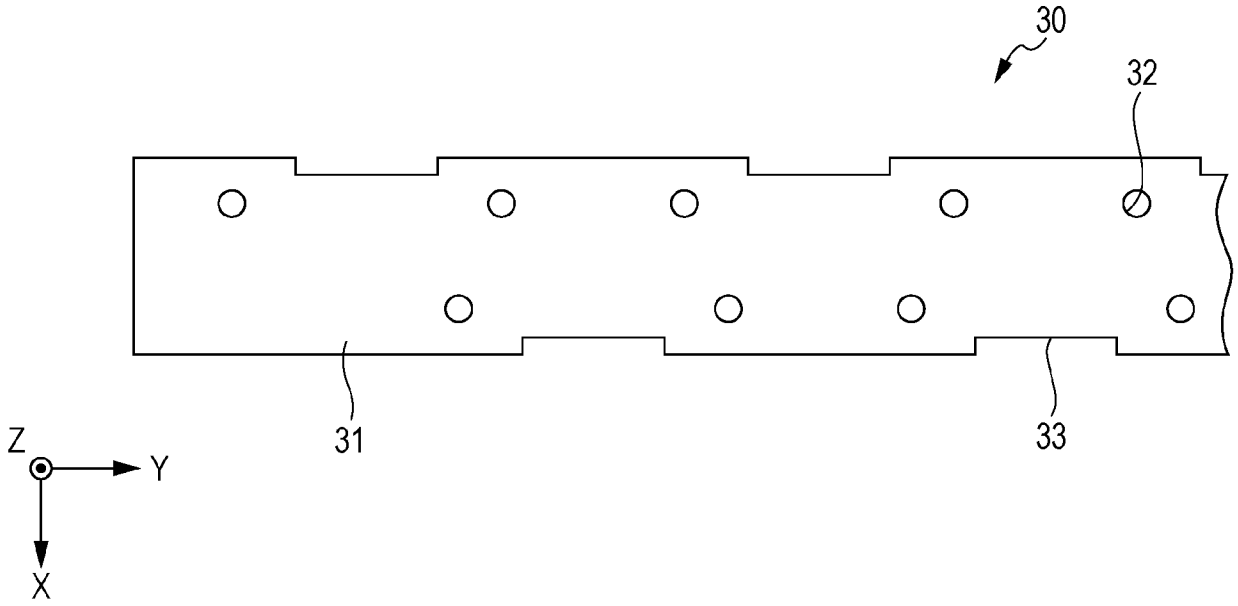
FIG. 7 is a top view illustrating a holding member according to the embodiment.
Figure 8:
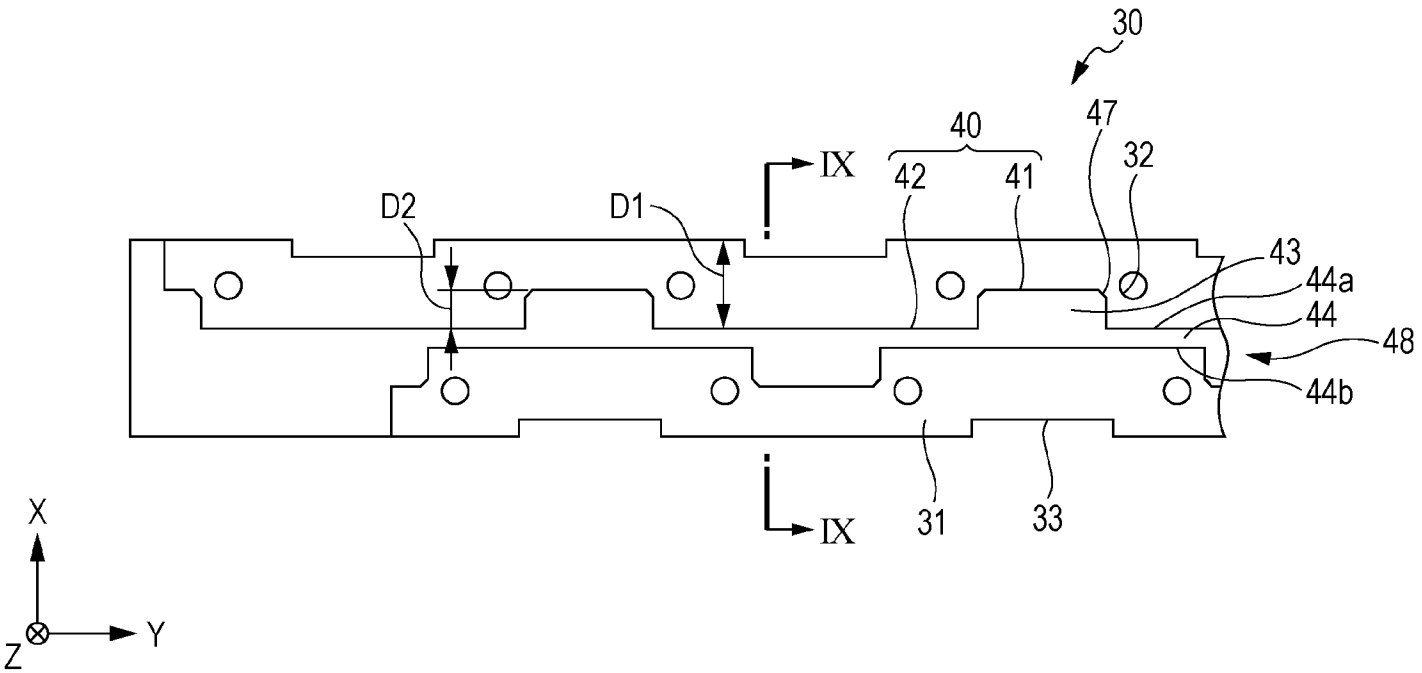
FIG. 8 is a bottom view illustrating the holding member according to the embodiment.
Figure 9:
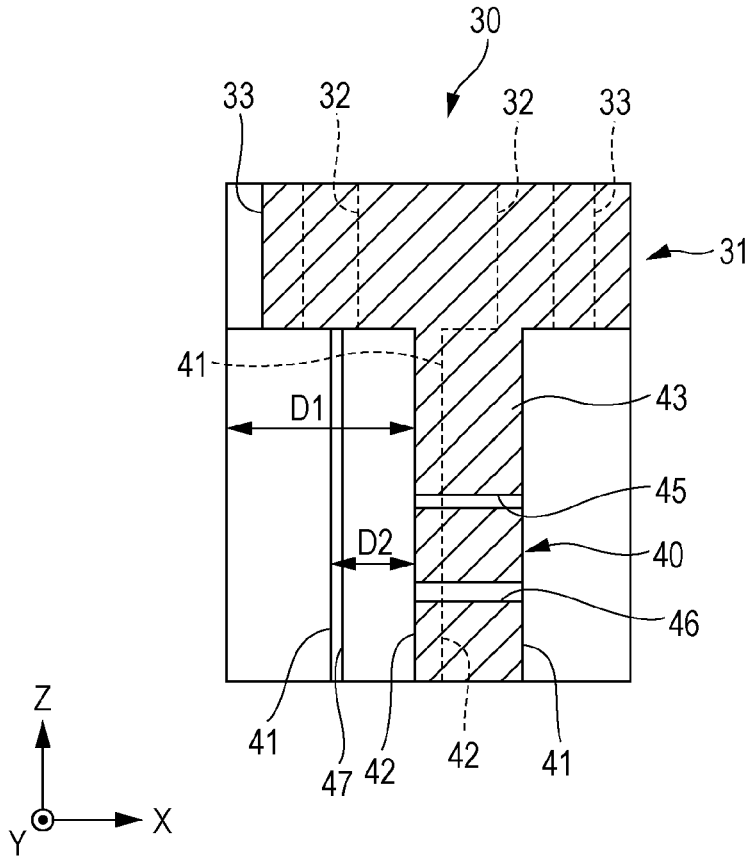
FIG. 9 is a cross-sectional view taken along a IX-IX line in FIG. 8.

Details of the holding member will be described with reference to FIGS. 6 through 9 hereinafter. FIG. 6 is a front view of the holding member, FIG. 7 is a top view of the holding member, FIG. 8 is a bottom view of the holding member, and FIG. 9 is a cross-sectional view taken along a IX-IX line in FIG. 8.

The holding member 30 is a member that is formed to be elongated in the Y direction and that holds a head row 10A and a head row 10B. More specifically, the holding member 30 includes a base portion 31 and a holder formation portion 48 having a plurality of holders 40 to which the heads 10 are attached.

The base portion 31 is a portion that is formed in a plate-like shape having a surface approximately parallel to the nozzle surface 15 (see FIG. 5), and that is located on the top face side of the heads 10. A connection channel 32 is provided in the base portion 31 penetrating through in the thickness direction. The ink channel connection portion 17 of the head 10 (see FIG. 3) is fitted into the connection channel 32. The connection channel 32 is supplied with ink from a liquid storage unit (not shown) such as an ink cartridge via a tube or the like. Ink having been supplied to the connection channel 32 is supplied to the ink channel connection portion 17, and then supplied to the main head body 12. In this embodiment, two connection channels 32 are provided for each of the heads 10 in the base portion 31.

A connection wiring recess 33 is provided on a side surface of the base portion 31 (surface parallel to the Y-Z plane). The connection wiring 19 connected with the head 10 (see FIGS. 3 and 4) is accommodated in the connection wiring recess 33.

The holder formation portion 48 is a member in which the plurality of holders 40 are formed. In this embodiment, the holder formation portion 48 is formed in a plate-like shape longer in the Y direction and shorter in the X direction and is erected on the base portion 31, and the plurality of holders 40 to which the heads 10 are attached are formed on both side surfaces thereof orthogonal to the Y direction. The head rows 10A and 10B are respectively arranged on both sides in the Y direction of each of the plurality of holders 40 (holder formation portion 48) and fixed to the corresponding holders.

Of the holding member 30 in this embodiment, the holder 40 is a region in which each of the heads 10 is attached, and which includes a head attachment surface 41 and an accommodation portion 42. The head attachment surface 41 is a region where the fixing portion 20 of the head 10 is fixed, and the accommodation portion 42 is a space in which the main head body 12 and channel member 13 of the head 10 are accommodated. In this embodiment, the head attachment surface 41 and the accommodation portion 42 are formed as follows.

The holder formation portion 48 includes a plurality of thick portions 43 relatively thicker in the X direction and a plurality of thin portions 44 formed thinner than the thick portions 43. The thick portions 43 are portions sticking out in the X direction respectively from a side surface 44*a* and a side surface 44*b* orthogonal to the Y direction of the thin portions 44. On both the side surfaces of the holder formation portion 48 (side surfaces 44*a*, 44*b*), a region between the thick portions 43 adjacent to each other in the Y direction becomes the accommodation portion 42, and the surface of the thick portion 43 (surface orthogonal to the Y direction) becomes the head attachment surface 41.

The thick portions 43 provided on the side surfaces 44*a* and 44*b* of the holder formation portion 48 are arranged in a zigzag pattern along the Y direction. That is, the position of the thick portion 43 on the side surface 44*a* (side surface 44*b*) side of the holder formation portion 48 is arranged to overlap with the position of the accommodation portion 42 on the side surface 44*b* (side surface 44*a*) side in the Y direction. Because of the holders 40 having the above-described accommodation portions 42 being formed, the holders are arranged in a zigzag pattern along the Y direction so that the heads 10 held by the corresponding holders 40 are arranged in the zigzag-pattern, details of which will be explained later.

Here, the depth in the X direction from a side surface of the base portion 31 to the bottom surface of the accommodation portion 42 (front face of the thin portion 44) is taken as D1, and the depth in the X direction from the head attachment surface 41 to the bottom surface of the accommodation portion 42 is taken as D2. The depth D1 is formed slightly deeper than the width in the X direction of the head 10. The depth D2 is formed slightly deeper than a width W from the fixing portion 20 to a side surface in the X direction of the head 10 (see FIG. 4).

Accordingly, the head 10 fixed to the head attachment surface 41 is accommodated in the accommodation portion 42 without making contact with the bottom surface of the accommodation portion 42 and also without sticking out from the side surface of the base portion 31.

The area of the head attachment surface 41 is smaller than that of the accommodation portion 42 (bottom surface of the accommodation portion 42). Further, flatness error of the head attachment surface 41 is smaller than that of the bottom surface of the accommodation portion 42 (the head attachment surface 41 is better in terms of profile irregularity).

As described above, in order to arrange the heads 10 attached to the holding member 30 in a zigzag pattern, the holders 40 including the accommodation portions 42 are arranged in the zigzag pattern. In other words, the interval in the X direction between the head rows 10A and 10B can be shortened by an amount of the depth of the accommodation portion 42, which results in the compact head unit 1.

If the holder formation portion 48 is simply configured to have only the thin portions 44 so as to shorten the interval in the X direction between the head rows 10A and 10B, the holding member 30 will become weak in strength. However, in this embodiment, since the holder 40 including the accommodation portion 42 is configured with the thick portion 43 and the thin portion 44, strength of the holding member 30 can be enhanced.

As will be explained later, since the head attachment surface 41 becomes a positioning reference of the head 10, the flatness error thereof need be small enough. Then, the positioning precision is enhanced by causing the flatness error of the head attachment surface 41 to which the head 10 is attached to be smaller than that of the bottom surface of the accommodation portion 42. In addition, the part in which the flatness error is required to be small is limited to the head attachment surface 41 by causing the head 10 to make contact with the head attachment surface 41 and not to make contact with the bottom surface of the accommodation portion 42, and making the area of the head attachment surface 41 smaller than that of the bottom surface of the accommodation portion 42.

As described above, by limiting the part in which a smaller flatness error is required to enhance the positioning precision of the head 10 to the head attachment surface 41 which is smaller in area than the bottom surface of the accommodation portion 42, it is possible to enhance the precision of attachment of the head 10 and to reduce manufacturing costs of the holding member 30.

The following can be cited as a manufacturing method of the holding member 30 in the case where the material thereof is a metal. That is, the thin portion 44 is machined by an NC cutting machine, subsequently the surface of the remaining thick portion 43 is finished by milling so as to form the head attachment surface 41; as a result, the holding member 30 can be manufactured.

As described above, as the area of the head attachment surface 41 is smaller, the finishing is easier and can be carried out in a shorter period of time, which makes it possible to obtain a predetermined quality without requiring extra costs.

In the case where the material of the holding member 30 is a metal, the head attachment surface 41 is the only portion that needs a size correction in the die, and it is easy to deal with sink marks due to thickness of resin by limiting an adjustment range in the manufacturing.

A positioning reference hole 45 and a fixing screw hole 46 each penetrating through in the width direction (X direction) of the thick portion 43 are provided in the head attachment surface 41. The positioning reference hole 45 specifies the relative positions between the heads 10, details of which will be explained later. The fixing screw hole 46 is a screw hole in which a fixing screw inserted through the fixing screw insertion hole 22 of the head 10 (see FIG. 3) is screwed, details of which will be explained later. The head 10 is fixed to the head attachment surface 41 with the fixing screw.

The accommodation portion 42 located on one of both the sides of the side surfaces (side surface 44*a*, side surface 44*b*) of the holder formation portion 48 is so provided as to overlap the head attachment surface 41 (thick portion 43) in the Y direction. Meanwhile, one head attachment surface 41 is provided between the two accommodation portions 42 adjacent to each other. Each of the fixing portions 20 of the two heads 10 that are respectively accommodated in those accommodation portions 42 adjacent to each other, is fixed to the one head attachment surface 41.

In this embodiment, the four accommodation portions 42 corresponding to the head row 10A and the four accommodation portions 42 corresponding to the head row 10B are respectively provided on both the side surfaces of the holder formation portion 48, and the head attachment surfaces 41 are provided at both end sides in the Y direction of each of the accommodation portions 42. By attaching each of the heads 10 to the holder 40 having the above-described head attachment surface 41 and accommodation portion 42, the head row 10A and the head row 10B are disposed sandwiching the holders 40 therebetween so as to be arranged in a zigzag pattern along the Y direction, details of which will be explained later.

Further, a tapered surface 47 is formed at a boundary between the head attachment surface 41 and the accommodation portion 42. The tapered surface 47 functions as a lead-in structure for guiding the head 10 into the accommodation portion 42 (holder 40 side), details of which will be explained later.

Note that in the holding member 30, the base portion 31 and the holder formation portion 48 in which the plurality of holders 40 are integrally formed as one unit, are formed as one unit. This enhances the rigidity of the holding member 30. Needless to say, the base portion 31 and the holder formation portion 48 may be formed as different members from each other, and the holding member 30 may be formed by bonding those different members. Further, although the material of the holding member 30 is not limited to any specific material, it is preferable to use a material having a sufficient rigidity such as SUS or the like. Furthermore, although the holders 40 are integrally formed as one unit as a common material in the holder formation portion 48, the invention is not limited thereto. For example, the holders 40 may be configured for each of the heads 10, and each of the holders 40 may be attached to the base portion 31 so as to form the holding member 30.

Figure 10:
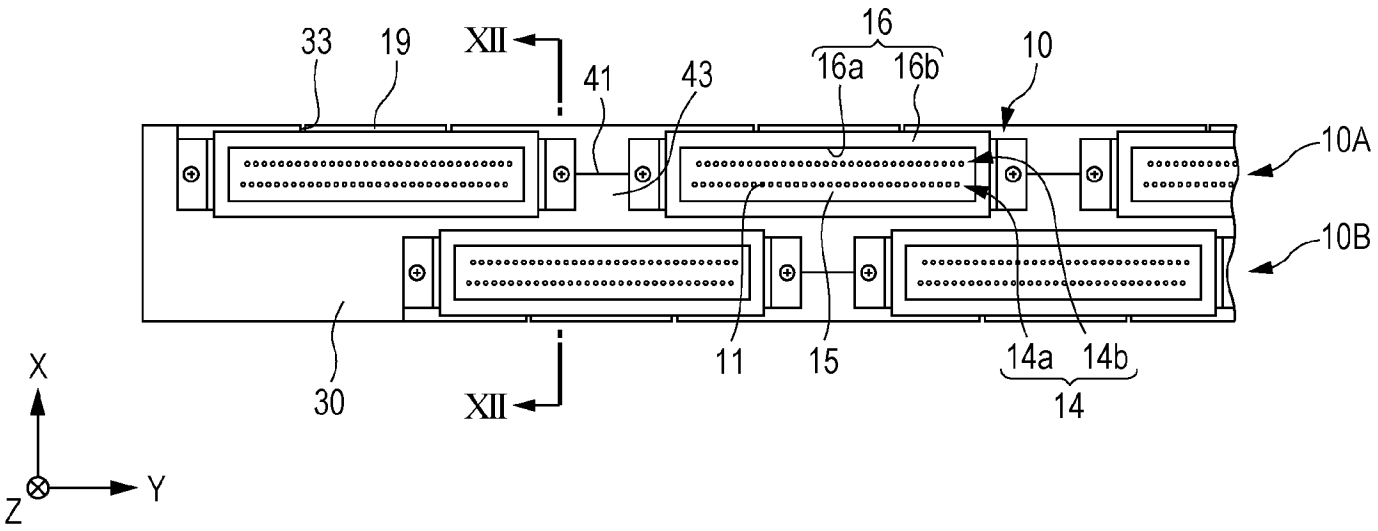
FIG. 10 is a bottom view illustrating the head unit according to the embodiment.
Figure 11:
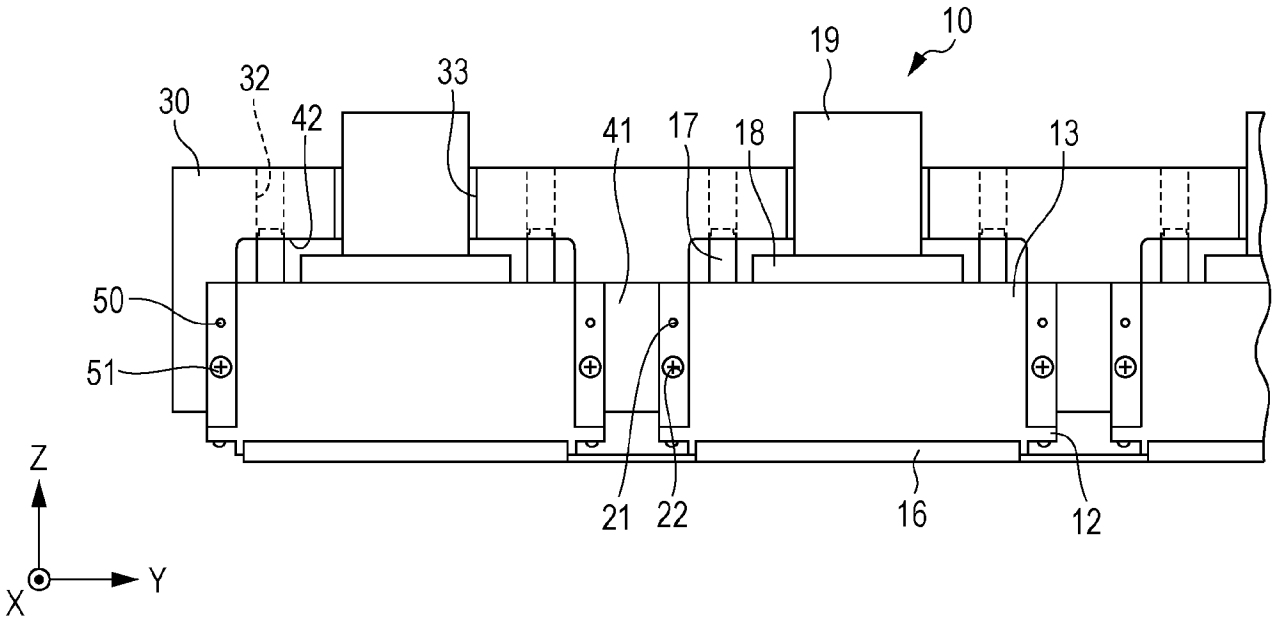
FIG. 11 is a front view illustrating the head unit according to the embodiment.
Figure 12:
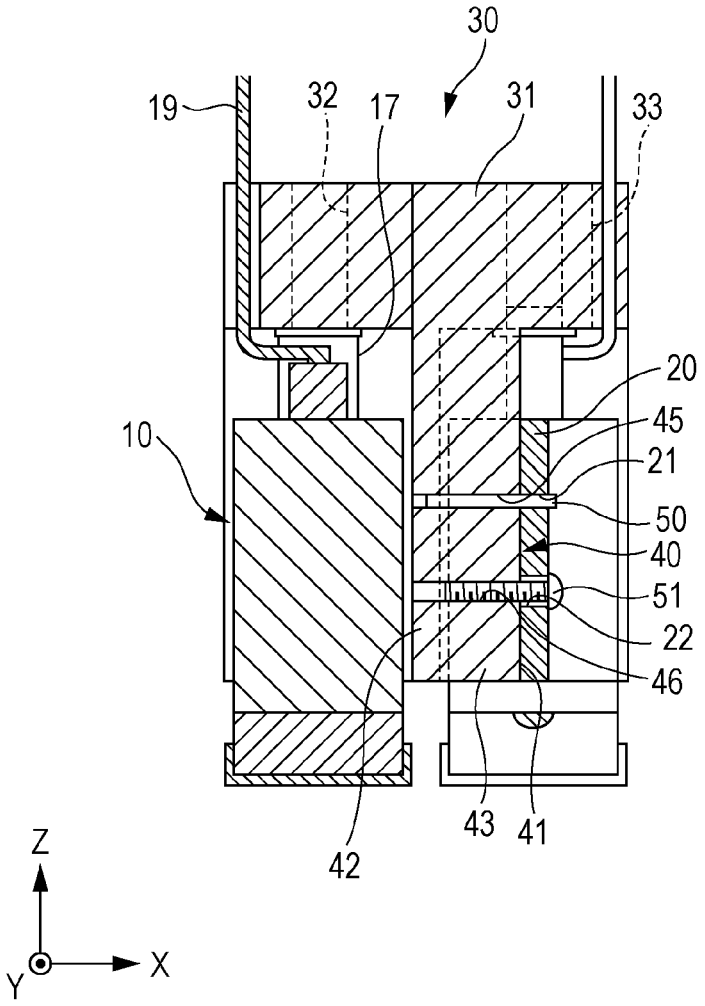
FIG. 12 is a cross-sectional view taken along a XII-XII line in FIG. 10.

Hereinafter, a structure in which the heads 10 are attached to the holding member 30 will be described in detail with reference to FIGS. 10 through 12. FIG. 10 is a bottom view of the head unit, FIG. 11 is a front view of the head unit, and FIG. 12 is a cross-sectional view taken along a XII-XII line in FIG. 10.

The head row 10A and the head row 10B sandwich the holders 40 of the holding member 30, and the heads 10 are fixed to the corresponding holders 40. To be more specific, the heads 10 are fixed in the following manner.

The main head body 12 and the channel member 13 of each of the heads 10 are accommodated in the corresponding accommodation portion 42, and the fixing portion 20 thereof is in contact with head attachment surface 41. A positioning pin 50 is inserted through both the positioning hole 21 provided in the fixing portion 20 of the head 10 and the positioning reference hole 45 provided in the head attachment surface 41. The openings of the positioning hole 21 and the positioning reference hole 45 are both formed in a shape so as to make the opening to be in contact with the outer circumference of the positioning pin 50.

Further, a fixing screw 51 is inserted through the fixing screw insertion hole 22 provided in the fixing portion 20 and screwed into the fixing screw hole 46 provided in the head attachment surface 41. Note that the fixing screw 51 is not screwed into the fixing screw insertion hole 22, and the head of the fixing screw 51 fixes the fixing portion 20 to the head attachment surface 41.

In the head 10 being fixed as described above, the ink channel connection portion 17 is fitted into the connection channel 32, through which the interiors thereof communicate with each other. With this, ink is supplied from a liquid storage unit (not shown) such as an ink cartridge or the like to the connection channel 32 via a tube or the like, and then further supplied to the main head body 12 via the ink channel connection portion 17.

The connection wiring 19 connected with the head 10 is accommodated in the connection wiring recess 33 provided on the base portion 31, and an end portion thereof is connected to a control device (not shown) that supplies a drive signal. Providing the connection wiring recess 33 on the base portion 31 makes it possible to accommodate the connection wiring 19 while preventing the connection wiring 19 from sticking out from a side surface of the base portion 31.

The head attachment surface 41 to which the head 10 is fixed in the manner described above and the positioning reference hole 45 function as a positioning reference that specifies the relative positions between the heads 10.

The head attachment surface 41 specifies the positions in the X direction of the heads 10. In other words, the position of the head 10 is determined by the fixing portion 20 of the head 10 making contact with the head attachment surface 41.

The positioning reference hole 45 specifies the positions in the Y and Z directions of the heads 10. In other words, the positioning hole 21 of the head 10 is positioned to the same position as that of the positioning reference hole 45 in the Y-Z plane and the positioning pin 50 is inserted through these holes, whereby the position of the head 10 in the Y and Z directions is determined. That is, by inserting the positioning pin 50 through the positioning reference hole 45 and the positioning hole 21, movement of the head 10 in the Y and Z directions is restricted.

In a state in which the position in the X, Y and Z directions is specified by the head attachment surface 41 and the positioning reference hole 45, as described above, the head 10 is fixed to the head attachment surface 41 with the fixing screw 51.

The head attachment surface 41 and the positioning reference hole 45, which functions as the positioning reference in the manner described above, are formed in the holder 40 so as to specify the relative positions between the heads 10 being positioned by the head attachment surface 41 and positioning reference hole 45.

Here, the "relative positions between the heads 10" refers to an arrangement of the heads 10 such that the heads 10 are arranged in a zigzag pattern in the Y direction and the nozzle rows 14 of the heads 10 form a single continuous nozzle row unit.

The "heads 10 are arranged in a zigzag-pattern" refers to an arrangement as follows. That is, the nozzle openings 11 (one or more in number) located at the end side in the Y direction of the head 10 of the head row 10A (head row 10B) are arranged so that the position thereof overlaps with the position in the Y direction of the nozzle openings 11 of the head 10 of the head row 10B (head row 10A).

In the manner as describe above, the nozzle rows 14 are arranged to overlap partly with each other in the Y direction between the heads 10 so as to continue the nozzle rows 14, whereby the nozzle row unit forming the maximum print width as a whole is configured. In other words, the nozzle row unit is a unit in which the nozzle rows of all of the heads 10 in the head unit 1 are continued. In this embodiment, the positioning reference is formed as follows in order to form the above nozzle row unit. That is, the head attachment surfaces 41 each serving as the positioning reference in the X direction are flush with each other with respect to every both sides of the holders 40. In other words, the nozzle rows 14*a* and 14*b* of the head row 10A and of the head row 10B being attached to the corresponding head attachment surfaces 41, are each linearly aligned on a line parallel to the Y direction.

The positioning reference holes 45 each serving as the positioning reference in the Y and Z directions are formed so that the end portion of the nozzle openings 11 is overlapped in the Y direction in the manner described above, and the nozzle surfaces 15 are flush with each other in the Z direction.

By positioning the head 10 to the head attachment surface 41 and the positioning reference hole 45 serving as the positioning reference and fixing the head 10 with the fixing screw 51, there is provided the head unit 1 in which the nozzle surfaces 15 are flush with each other, the head rows 10A and 10B are opposed to each other sandwiching the holders 40 therebetween, and therefore the nozzle row unit is formed.

In the head unit 1 provided with the heads 10 whose relative positions are specified as described above, each of the heads 10 is supplied with ink from an ink cartridge (not shown) and ink droplets are discharged through the nozzle openings 11 based on the drive signal from the control device.

In the head unit 1 having been described thus far, each of the heads 10 is attached to the holder 40 of the holding member 30. In other words, the fixing portion 20 of the head 10 is not attached to a surface parallel to the nozzle surface 15, but attached to the head attachment surface 41 intersecting with the nozzle surface 15.

Here, assume that the interval between the heads 10 is shortened so as to cause the nozzle openings 11 of the heads 10 configuring the head row 10A and head row 10B to overlap with each other in the Y direction. This requires the fixing portion 20 located between the heads 10 to be shorter in width in the Y direction. However, by widening the width in the Z direction of the fixing portion 20, the fixing portion 20 can have a sufficiently large size for stably fixing the head 10 to the head attachment surface 41.

According to the invention, as described above, the head row unit is formed by making the interval between the heads 10 shorter, and the head unit 1 is provided in which the heads 10 are stably fixed to the holding member 30. In addition, because the heads 10 are stably fixed to the holding member 30 while the relative positions of the heads 10 are precisely arranged so as to form the head row unit, the head unit 1 has a favorable ink discharge characteristic.

Like in the past technique, if it is attempted to fix the heads 10 to a member equivalent to the holding member on a surface parallel to the nozzle surface 15, a part for fixing the head 10 to the above-mentioned member need be formed more finely as the interval between the heads 10 is shorter. Because of this, the head 10 cannot be stably fixed to the above-mentioned member.

Moreover, in the head unit 1, it is possible to position the head 10 in the X, Y and Z directions with the head attachment surface 41 and positioning reference hole 45 provided in the holder 40. In other words, the head unit 1 can be obtained in which the relative positions between the heads 10 are specified only by causing the fixing portion 20 of the head 10 to make contact with the head attachment surface 41 and inserting the positioning pin 50 into the positioning reference hole 45 and the positioning hole 21.

In the past technique, in order to specify the relative positions between the heads 10, for example, the positioning is performed so that the nozzle openings 11 of the respective heads 10 are positioned to be a predetermined arrangement. Specifically, the nozzle openings 11 are pictured with a CCD camera or the like, the positions of the heads 10 are finely adjusted so that the nozzle openings 11 in the picture are arranged at a predetermined interval, and then the heads 10 are fixed to a member equivalent to the holding member.

However, with the head unit 1 according to this embodiment, unlike in the past technique, the relative positions between the heads 10 can be specified without carrying out fine adjustment on the positions of the heads 10. This is particularly advantageous in maintenance operation at the site where the head unit 1 is being used, because it is possible to noticeably reduce a workload, time, or the like needed for exchanging a specified head 10.

Figure 13:
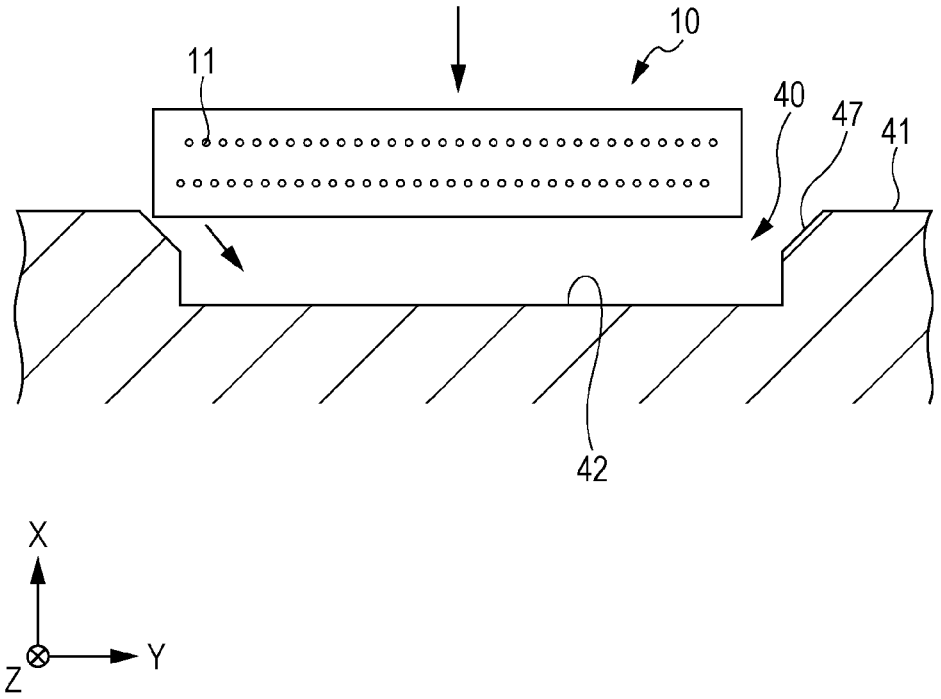
FIG. 13 is an enlarged bottom view illustrating a principal portion of the head unit for explaining a lead-in structure.

Providing the tapered surface 47 as a lead-in structure to the holder 40 makes it easy to attach the head 10 to the holder 40. This will be explained with reference to FIG. 13. FIG. 13 is an enlarged bottom view illustrating a principal portion of the head unit for explaining the lead-in structure.

As shown in FIG. 13, assume that the head 10 is to be accommodated in the accommodation portion 42 while being slightly deviated in the Y direction with respect to the accommodation portion 42. At this time, part of the head 10 makes contact with the tapered surface 47. Then, the head 10 is guided to the accommodation portion 42 side along the tapered surface 47.

Providing the lead-in structure to the accommodation portion 42 in the above manner makes it easy to accommodate the head 10 in the accommodation portion 42. With this, it is possible to reduce a workload, time, or the like needed for exchanging the heads 10 and to reduce maintenance costs in the exchanging of the heads.

Further, in the head unit 1 according to this embodiment, the accommodation portion 42 is provided in the holder 40, and the head 10 is accommodated in the accommodation portion 42 and fixed. This makes it possible to shorten the interval in the X direction between the head rows 10A and 10B that are arranged sandwiching the holders 40 therebetween. In other words, the interval between the nozzle rows 14 of the heads 10 can be shortened. By making the interval in the X direction between the nozzle rows 14 in the above manner, it is possible to suppress influence of meandering transport of a medium such as paper onto which ink is discharged, whereby deterioration in the print quality can be prevented.

Second Embodiment

Figure 14:
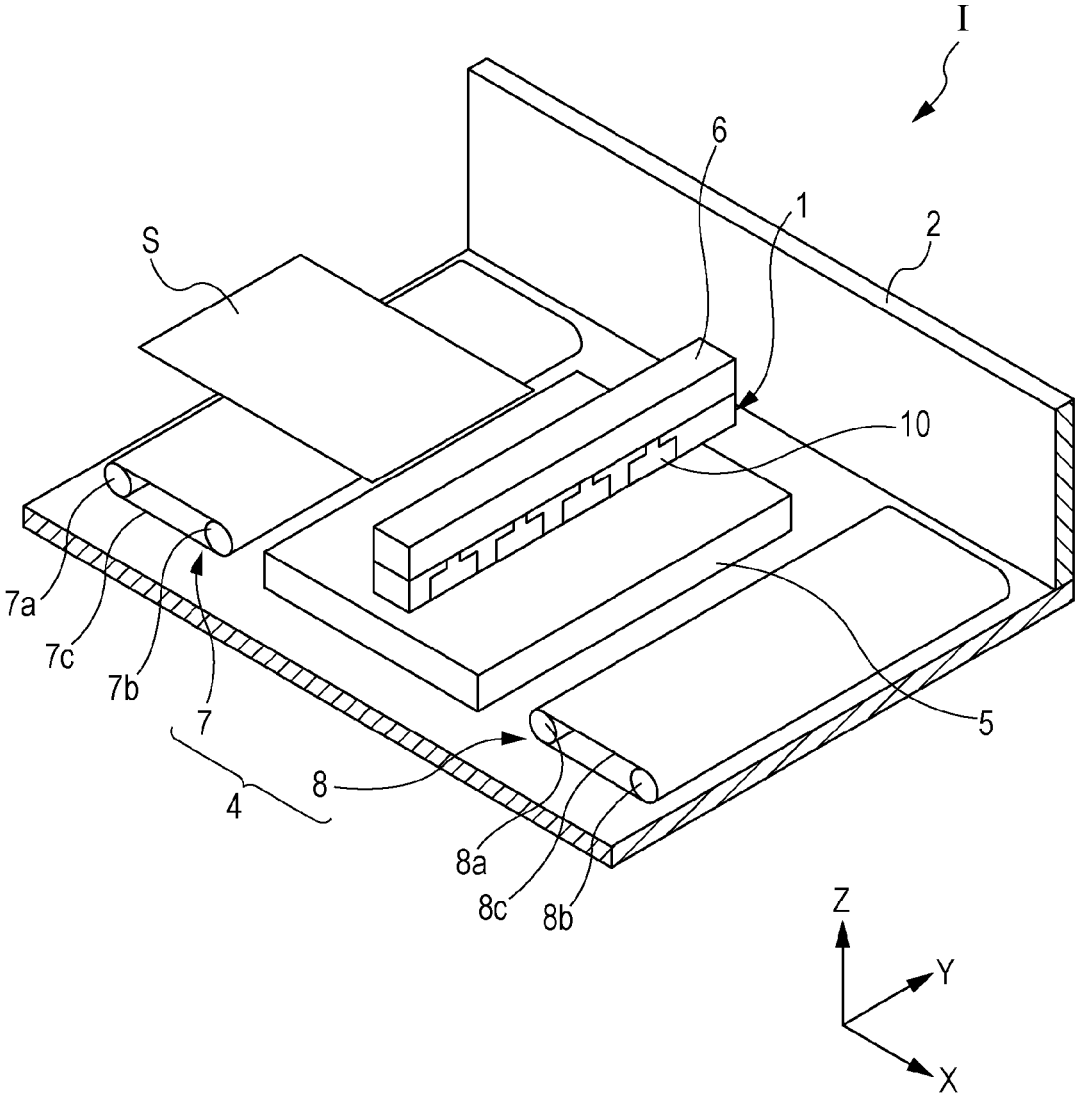
FIG. 14 is a schematic view illustrating a recording apparatus according to another embodiment of the invention.

An ink jet recording apparatus as an example of a liquid ejecting apparatus including the head unit 1 according to the first embodiment will be described. FIG. 14 is a schematic perspective view of an ink jet recording apparatus according to a second embodiment of the invention. Note that the same elements as those in the first embodiment are given the same reference numerals and duplicate description thereof will be omitted.

An ink jet recording apparatus I is what is known as a line type recoding apparatus in which the head unit 1 is fixedly installed and printing is performed by transporting an ejection-target medium such as a recording sheet. To be more specific, the ink jet recording apparatus I includes the head unit 1, a main apparatus body 2, and a transport unit 4 that transports an ejection-target medium S.

The head unit 1 is installed in the main apparatus body 2 so that the ejection-target medium S is transported in a transport direction (X direction) orthogonal to the alignment direction (Y direction) of the nozzle row 14 (see FIG. 5). As described in the first embodiment, in the head unit 1, the heads 10 are arranged in a zigzag pattern along the Y direction, and the nozzle row unit is included in the head unit 1. This makes it possible to perform printing across the entire area in the Y direction intersecting with the transport direction of the ejection-target medium S.

A channel member 6 is provided on the upper surface side of the head unit 1. The channel member 6 is a member that is supplied with ink from an ink storage unit (not shown) in which ink is stored such as an ink tank, an ink cartridge, or the like, and that supplies the ink to each of the heads 10 via the connection channel 32 of the holding member 30. The ink storage unit may be provided together with the channel member 6 as one unit, or may be held at a different position from that of the head unit 1 in the main apparatus body 2.

A transport unit 4 includes a first transport unit 7 and a second transport unit 8 that are respectively provided on both sides in the X direction of the head unit 1.

The first transport unit 7 is configured of a drive roller 7*a*, a driven roller 7*b*, and a transport belt 7*c* wound upon the drive roller 7*a* and the driven roller 7*b*. The second transport unit 8 includes, like the first transport unit 7, a drive roller 8*a*, a driven roller 8*b*, and a transport belt 8*c*.

The drive roller 7*a* of the first transport unit 7 and the drive roller 8*a* of the second transport unit 8 are each connected with a driving unit (not shown) such as a driving motor, and the ejection-target medium S is transported on the upstream side and the downstream side of the head unit 1 by rotation of the transport belts 7*c* and 8*c* each driven by a driving force of the driving unit.

In this embodiment, the first transport unit 7 configured of the drive roller 7*a*, the driven roller 7*b* and the transport belt 7*c*, and the second transport unit 8 configured of the drive roller 8*a*, the driven roller 8*b* and the transport belt 8*c* are exemplified; however, a holding unit that causes the ejection-target medium S to be held on the transport belts 7*c* and 8*c* may be additionally provided. For example, the holding unit may have a charging unit that charges the outer periphery of the ejection-target medium S, and may cause the charged ejection-target medium S to stick to the upper side of the transport belts 7*c*, 8*c* by the effect of dielectric polarization. Further, a press-down roller may be provided as a holding unit on each of the transport belts 7*c* and 8*c*, and the ejection-target medium S may be pinched between the press-down rollers and the transport belts 7*c*, 8*c*.

According to the above-mentioned ink jet recording apparatus I, preferable printing can be performed on the ejection-target medium S because the heads 10 are stably fixed to the holding member 30.

In the example described above, although the head unit 1 is fixed to the main apparatus body 2 and the transport unit 4 is configured to transport the ejection-target medium S, the invention is not limited to such mode. Since it is sufficient that the transport unit 4 relatively moves the head unit 1 and the ejection-target medium S, the transport unit 4 may transport the head unit 1 while the ejection-target medium S being fixed. Moreover, the ink jet recording apparatus I may include not only the single head unit 1, but also a plurality of head units 1.

OTHER EMBODIMENTS

Thus far, the embodiments of the invention have been described. However, the configuration of the invention is not limited thereto.

For example, although the positioning reference hole 45 as a positioning reference specifies a position in the Y and Z directions of the head 10, the invention is not limited thereto. That is, for example, the positioning reference hole 45 is considered to be a hole that specifies a position in the Y direction. In this case, the positioning reference hole 45 has such a diameter in the Y direction that makes contact with the outer circumference of the positioning pin 50, and has such a diameter in the Z direction that is larger than the positioning pin 50. In other words, the positioning reference hole 45 is made to be an elongate hole, which is lengthened in the Z direction.

With this, in the case where the positioning pin 50 is inserted through the positioning reference hole 45 and the positioning hole 21, the head 10 is restricted to move in the Y direction but allowed to move in the Z direction to a small extent.

Then, the base portion 31 is provided with a positioning reference (base portion-side reference) in the Z direction. Although the form or the like of the base portion-side reference is not limited to any specified form or the like, a part in contact with the upper surface of the head 10 can be made to be the base portion-side reference, for example. The base portion-side reference is provided to the base portion 31 so as to specify the relative positions in the Z direction between the heads 10 that are fixed to the holder 40 being positioned in compliance with the base portion-side reference.

As described above, in the case where the positioning reference in the Z direction can be provided to the base portion 31, the position in the Z direction of the head 10 can be specified through positioning the head 10 in compliance with the positioning reference provided to the base portion 31.

The positioning references can be realized in various modes without being limited to the head attachment surface 41, the positioning reference hole 45, or the like. For example, a projection provided on a side surface of the holder 40 (surface orthogonal to the Y direction of the thick portion 43) can be made to be a positioning reference in place of the positioning reference hole 45. By inserting the projection through the positioning hole 21, the position of the head 10 can be specified.

The invention can be widely applied to liquid ejecting heads in general. That is, the invention can be applied to, for example, recording heads such as various kinds of ink jet recording heads that are used in image recording apparatuses such as a printer or the like, coloring material ejecting heads used in the manufacture of color filters for liquid crystal displays and the like, electrode material ejecting heads used in the formation of electrodes for organic EL displays, field ejection displays (FEDs) and the like, bioorganic matter ejecting heads used in the manufacture of biochips, and so on. It is needless to say that liquid ejecting apparatuses equipped with these liquid ejecting heads are not limited to any specified apparatuses.

What is claimed is:

1. A liquid ejecting head unit comprising:

a plurality of liquid ejecting heads each having a liquid ejecting surface provided with a nozzle row in which nozzle openings through which liquid is discharged are aligned in a first direction; and a holding member that includes a plurality of holders in which the liquid ejecting heads are attached to a surface intersecting with the liquid ejecting surface, wherein positioning references are provided in each holder that specify relative positions between the liquid ejecting heads and the holders, the liquid ejecting heads are fixed to the holders in compliance with alignment of the positioning references with complementary positioning references that extend through the liquid ejecting heads in a direction orthogonal to the first direction, and a positioning member for each positioning reference and corresponding complementary positioning reference, wherein the positioning members are inserted through both a portion of the positioning references and the complementary positioning references.

2. The liquid ejecting head unit according to claim 1, wherein in a case where the direction orthogonal to the first direction in the liquid ejecting surface is taken as a second direction, a second positioning reference is provided so as to specify at least the relative positions, with the positioning references, in the first and second directions between the liquid ejecting heads that are fixed to the holders being positioned in compliance with the positioning references.

3. The liquid ejecting head unit according to claim 1, wherein in a case where the direction orthogonal to the first direction in the liquid ejecting surface is taken as the second direction and a direction orthogonal to both the first and second directions is taken as a third direction, a second positioning reference is provided so as to specify at least the relative positions, with the positioning references, in the third direction between the liquid ejecting heads that are fixed to the holders being positioned in compliance with the positioning references.

4. The liquid ejecting head unit according to claim 1, wherein the holding member includes a base portion-side reference and further includes a base portion that sticks out from the holders to a side where the liquid ejecting heads are attached, and in a case where a direction orthogonal to the liquid ejecting surface is taken as the third direction, the base portion-side reference is provided so as to specify the relative positions in the third direction between the liquid ejecting heads that are fixed to the holders being positioned in compliance with the base portion-side reference.

5. The liquid ejecting head unit according to claim 1, wherein each holder is provided with a lead-in structure that guides the liquid ejecting head to the holder side.

6. The liquid ejecting head unit according to claim 1, wherein each liquid ejecting head includes a main head body for discharging liquid and a fixing portion sticking out in the first direction from the main head body, each holder of the holding member includes a head attachment surface to which the fixing portion is fixed and an accommodation portion recessed from the head attachment surface, and the fixing portion of the liquid ejecting head is fixed to the head attachment surface and at least part of the main head body is accommodated in the accommodation portion.

7. The liquid ejecting head unit according to claim 4, wherein the base portion and the holders are integrally formed in the holding member.

8. A liquid ejecting apparatus comprising:

the liquid ejecting head unit according to claim 1.

9. The liquid ejecting head unit according to claim 1, wherein in a case where the direction orthogonal to the first direction in the liquid ejecting surface is taken as a second direction, the holders are provided on both sides of the holding member in the second direction.

10. The liquid ejecting head unit according to claim 1, wherein in a case where the direction orthogonal to the first direction in the liquid ejecting surface is taken as a second direction, a plurality of accommodation portions recessed in the second direction are provided on both sides of the holding member in the second direction, each of the accommodation portions is configured to accommodate at least a part of one of the liquid ejecting heads.

11. The liquid ejecting head unit according to claim 1, wherein in a case where the direction orthogonal to the first direction in the liquid ejecting surface is taken as a second direction, a plurality of connection wiring recesses recessed in the second direction are provided on both sides of the holding member in the second direction, each of the connection wiring recesses is configured to accommodate a connection wiring connected with one of the liquid ejecting heads.

12. The liquid ejecting head unit according to claim 1, wherein the positioning references each include a head attachment surface where one of the liquid ejecting heads is fixed.

13. The liquid ejecting head unit according to claim 1, wherein each positioning member includes a positioning pin.

14. The liquid ejecting head unit according to claim 1, wherein the holding member includes a holder for each of the liquid ejecting heads, wherein each holder includes an accommodation portion that includes a bottom surface and a head attachment surface that is a surface that intersects with the liquid ejecting surface, wherein, for each holder, the liquid ejecting head is accommodated in the accommodation portion without contacting the bottom surface, the liquid ejecting head is attached to the head attachment surface, and the positioning reference specifies relative positions between the liquid ejecting heads and the holder.

15. The liquid ejecting head unit according to claim 1, wherein the positioning references provided in each holder specify relative positions between the liquid ejecting heads in at least two directions including the first direction.

* * * * *